United States Patent [19]

Neumann et al.

[11] 4,274,340

[45] Jun. 23, 1981

[54] RAILWAY CAR TRUCK FRICTIONAL SNUBBING ARRANGEMENT

[75] Inventors: Otto W. Neumann, Itasca; James A. Henkel, Park Forest, both of Ill.

[73] Assignee: AMSTED Industries Incorporated, Chicago, Ill.

[21] Appl. No.: 84,669

[22] Filed: Oct. 15, 1979

[51] Int. Cl.[3] ..... B61F 5/06; B61F 5/12; B61F 5/24; B61F 5/50

[52] U.S. Cl. ..... 105/197 DB; 267/9 A

[58] Field of Search ..... 105/197 D, 197 DB; 267/9 A

[56] References Cited

U.S. PATENT DOCUMENTS

| | | | |
|---|---|---|---|
| 2,375,306 | 5/1945 | Baselt et al. | 105/197 D |
| 2,378,414 | 6/1945 | Light | 105/197 DB |
| 2,378,415 | 6/1945 | Light | 105/197 DB |
| 2,720,172 | 10/1955 | Baselt | 105/197 DB |
| 2,953,995 | 9/1960 | Baker | 105/197 DB |
| 3,805,707 | 4/1974 | Neumann et al. | 105/197 DB |
| 4,103,623 | 8/1978 | Radwill | 105/197 DB |
| 4,109,585 | 8/1978 | Brose | 105/197 DB |

*Primary Examiner*—John P. Silverstrim
*Assistant Examiner*—Howard Beltran
*Attorney, Agent, or Firm*—John L. Schmitt; Fred P. Kostka; Edward J. Brosius

[57] ABSTRACT

A friction shoe particularly adapted for providing improved regulation of movement between a bolster and a side frame of a railroad car truck includes a central body portion and triangular-shaped wings formed on each side thereof. Pairs of these friction shoes are disposed in pockets formed at the ends of the bolster which in turn are resiliently carried in a window formed in each side frame. Each friction shoe wing has a downwardly and outwardly sloped wear surface to form a convex-like seating area. In turn, each bolster pocket has complementarily formed friction surfaces providing a concave-like receiving area. During operation of the truck, the shoe seating area interacts with the bolster pocket receiving area to produce a wedging action. This wedging action in turn insures improved frictional regulation of side frame-bolster movements and maintains such in an aligned relationship.

2 Claims, 8 Drawing Figures

FIG. 1
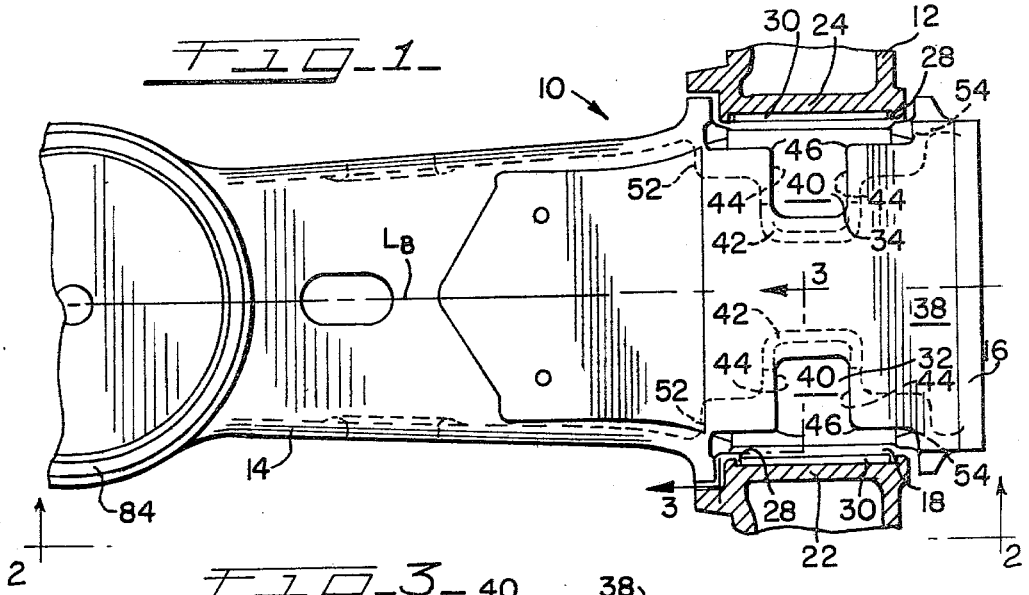
FIG. 3
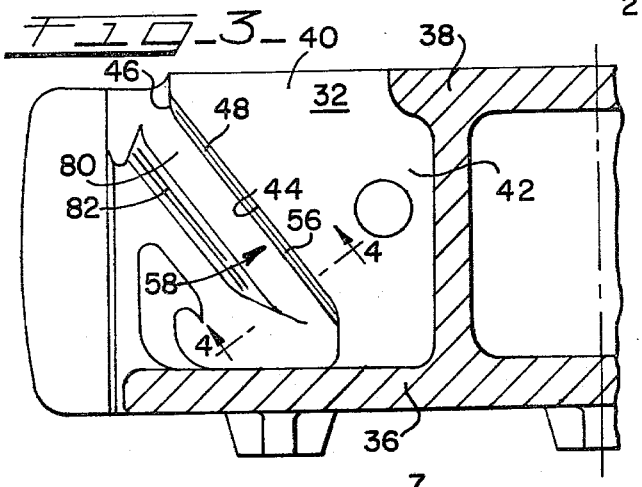
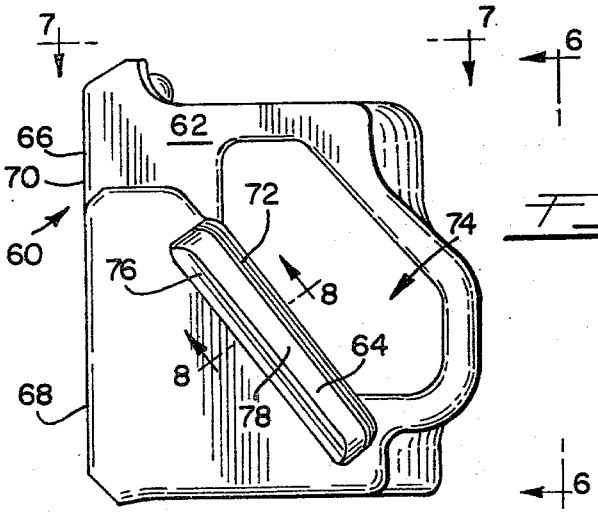
FIG. 5

RAILWAY CAR TRUCK FRICTIONAL SNUBBING ARRANGEMENT

BACKGROUND OF THE INVENTION

1. Field of Invention

This invention relates to railroad car trucks and more particularly to frictional snubbing arrangements used to regulate movement between a bolster of the truck and its side frames.

2. Prior Art

Railroad car trucks are well known and are a high developed art form wherein for generations trucks have been continuously improved to accommodate increased loading, higher operating speeds and in more recent years, deteriorating road beds.

The modern day railroad car truck is often referred to as a three-piece truck comprising in part a pair of spaced side frames connected by a transversely positioned bolster having its ends resiliently supported by the side frames respectively. The bolster in turn supports a body of the railroad car which is cushioned by the resilient bolster side frame connection.

This cushioning is commonly provided by sets of coil springs and must be used with a dampening or snubbing device to regulate oscillating inherently produced with coil spring cushioning.

Early examples of dampening or snubbing devices used to regulate the resilient affected movements between a truck bolster and its side frames are disclosed in U.S. Pat. Nos. 2,378,414 and 2,378,415 wherein a vertical surface on a friction shoe carried by the bolster engages a side frame vertical wear surface positioned at each end of the bolster. A spring is used to urge the friction shoe outward to maintain the frictional engagement at a near constant level.

U.S. Pat. No. 2,720,172 discloses a further snubbing arrangement wherein each friction shoe is carried within a pocket formed at ends of the bolster and is forced upwardly and outwardly by inclined positioned coil springs. A vertical friction wall of the shoe engages a vertical wear plate carried by the side frame to dampen vertical movements cushioned by a set of load carrying coil springs.

A still further snubbing arrangement is disclosed in U.S. Pat. No. 2,953,955 wherein a set of friction shoes each having a central body portion and a pair of spaced triangular-shaped wings carried thereby is positioned in a like set of pockets in the truck bolster. The central body portion is hollow to contain a spring which forces the shoe upward against spaced inclined friction surfaces in the bolster pocket and in turn outwardly and against a vertical wear plate fastened to sides of a window in the side frame.

A last snubbing arrangement is disclosed by U.S. Pat. No. 3,805,707 and is pertinent in that it discloses a snubbing arrangement providing variable regulation in that the level of frictional engagement between friction shoes and side frame wear plates increases and decreases as a function of the compressive state of coil spring on which the friction shoe is carried.

SUMMARY OF THE INVENTION

A railroad car truck includes a pair of spaced side frames joined by a transversely positioned bolster. The bolster in turn has each of its ends resiliently carried in windows formed in each side frame by a set of coil springs.

To maintain the bolster and side frames in a squared relationship as well as regulate and dampen vertical oscillating of the bolster inherent with a coil spring suspension, the bolster is formed with a pair of pockets located at each end of the bolster. In each pocket is a friction shoe.

Each friction shoe has a pair of spaced downwardly and outwardly sloped wear surfaces which form a convex-like seating area. The friction shoe seating area is urged upwardly in the pocket and against a pair of spaced downwardly and outwardly sloped friction surfaces forming a concave-like receiving area in the pocket. This engagement forces each friction shoe outwardly and against a vertical wear plate fastened to sides of the side frame window respectively. Vertical movement of the bolster is regulated by frictional interaction between the friction shoes and the vertical wear plates of the side frame.

The frictional dampening or snubbing arrangement of this invention has several advantages over other known arrangements.

First, interaction between the friction shoe and the bolster pocket is improved in that the double slope of the friction surfaces of bolster pockets forms the concave-like receiving area for complementary engagement with the convex-like shoe seating area of the shoe. This double sloped configuration helps to maintain the shoe centered within the pocket.

In known snubbing devices the friction shoe has a tendency to move outwardly, i.e. parallel to a longitudinal axis of the bolster producing uneven wear of the shoe and the pocket. In the snubbing arrangement of this invention, wear is more uniformly distributed to insure a more prolonged life. This longer wear is produced by insuring that interaction between the friction shoe and the bolster pocket is balanced and occurs over a substantial area of contact.

Additionally, the friction shoe-bolster pocket interaction produces a wedging effect which inhibits the bolster rolling to an out-of-square condition. For example, when two railroad cars are coupled at excessive speeds, the body of each car is forced backward creating a rotational force on the bolster through the bolster-car body center plate connection. With the friction shoe properly centered within bolster pockets, impact stresses in bolster-friction shoeside frame connection are maintained within reasonable limits. Thus, rotation of the bolster may be more readily accommodated.

This wedging effect is likewise beneficial to maintain bolster-side frame squareness during operations when dynamic forces induce three-dimensional movement between the side frames and the bolster.

DESCRIPTION OF THE DRAWINGS

FIG. 1 is a partial plan view of a railroad car truck incorporating in part the snubbing arrangement of this invention.

FIG. 3 is a cross-sectional view of a friction shoe pocket formed in a bolster of the truck of FIG. 1 as seen generally along the line 3—3 of FIG. 1.

FIG. 5 is a side elevational view of a friction shoe forming part of the snubbing arrangement of this invention.

DESCRIPTION OF THE PREFERRED EMBODIMENT

Figure 2:
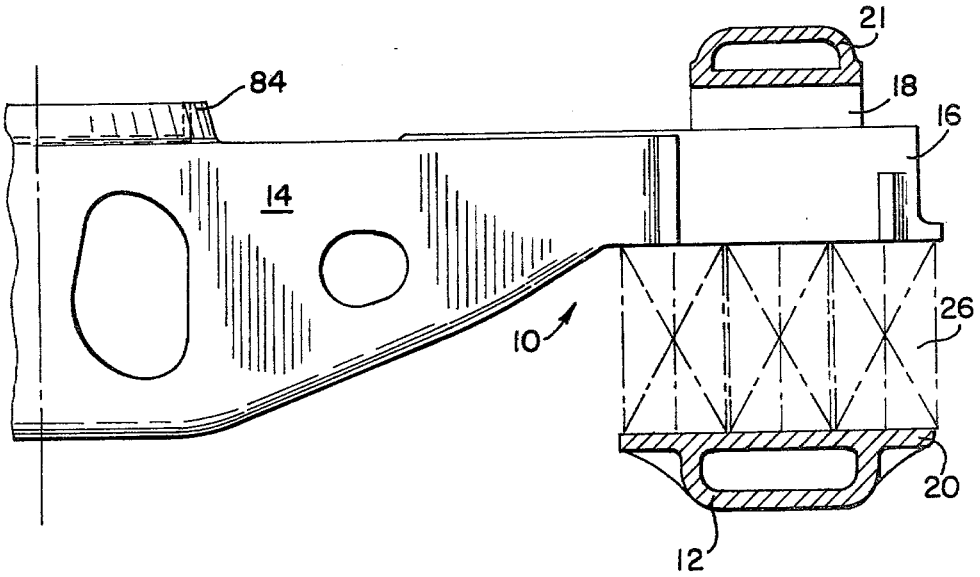
FIG. 2 is a cross-sectional view of the truck of FIG. 1 as seen generally along the line 2—2 of FIG. 1.

As seen in FIGS. 1 and 2 is a partial view of a railroad car truck shown generally and designated 10. The truck 10 includes a pair of spaced side frames with one such side frame shown in part and designated 12. The side frames are joined by a laterally positioned bolster 14 having an end 16 positioned within a window 18 formed in the side frame 12. It should be understood that an opposite end (not shown) of the bolster 14 is positioned in a like window formed in the other side frame.

The side frame window 18 is defined by a bottom horizontal tension member 20, a top horizontal compression member 21, and a front and a rear vertical sidewall 22 and 24. The truck 10 is in fact bi-directional and the use of front and rear merely aids in its description.

The tension member 20 serves as a support for a set of springs 26 (shown schematically) which in turn resiliently support the bolster 14 at the ends 16. Each bolster window vertical sidewall 22, 24 is formed with a recess 28 in which is fastened a wear plate 30.

At the end 16 of the bolster 14 and positioned on each side of a longitudinal axis $L_B$ of the bolster 14 is a front and a rear friction shoe pocket 32, 34. FIG. 3 shows the front friction shoe pocket 32 which is typical of the remainder. It should be understood that there are two such pockets likewise formed at the opposite (not shown) end of the bolster 14.

Figure 4:
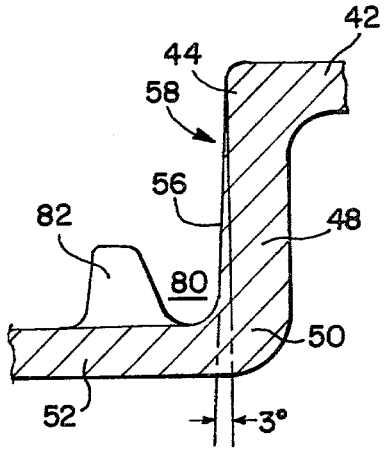
FIG. 4 is a cross-sectional view of the bolster pocket as seen generally along the line 4—4 of FIG. 3.
Figure 6:
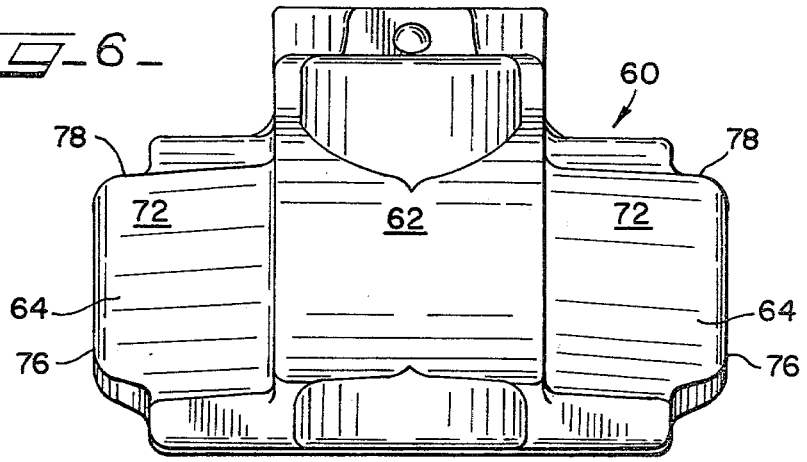
FIG. 6 is a front elevational view of the friction shoe of FIG. 5 as seen generally along the line 6—6 of FIG. 5.
Figure 7:
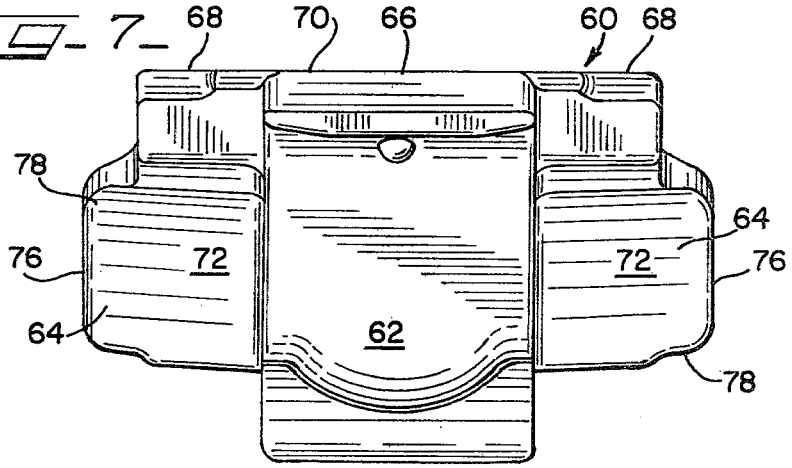
FIG. 7 is a plan view of the friction shoe of FIG. 5 as seen generally along the line 7—7 of FIG. 5.
Figure 8:
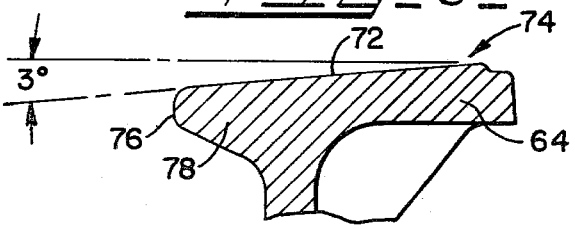
FIG. 8 is a cross-sectional view through a wing portion of the friction shoe of FIG. 5 as seen generally along the line 8—8 of FIG. 5.

The friction shoe pocket 34 is defined by a bottom member 36 and a top member 38 formed as an integral part of the bolster 14. A centrally located outwardly facing recess 40 in the top member 38 provides access to each pocket 32, 34. Aligned with the recess 40 and joining the top and bottom members 36, 38 is a U-shaped vertical partition 42 having spaced downwardly and inwardly sloped end walls 44. A top end 46 of each end wall 44 terminates at an outer end of the recess 40. Aligning with each end wall 44 and joined thereto is a friction member 48. An outer end 50 of each friction member 48 joins an inner and outer sidewall 52, 54 of the pockets 32, 34. The friction member 48 provides a double sloped friction surface 56 in that each friction surface 56 is downwardly sloped as seen in FIG. 3 and outwardly sloped as may be seen in FIG. 4. This double sloped configuration of the pairs of friction surfaces 56 produces an outwardly facing concave-like receiving area 58.

Disposed in each of the friction shoe pockets 32–34 is a friction shoe and, for example, a friction shoe 60 may be disposed in the front pocket 32. The shoe 60 is typical of the remainder and may best be understood by viewing FIGS. 5–8. The friction shoe 60 comprises a central body portion 62 and a pair of triangular-shaped wings 64 which project outwardly from each side of the body portion 62. A front vertical wall 66 of the central body portion 62 and front vertical walls 68 of the wings 66 join to form a front vertical friction surface 70.

In a bottom of the shoe 60 is a recess (not shown) to receive an upper end of a spring (not shown) having its lower end carried by the bottom member 36 of the friction shoe pocket 32. The spring is of such a length to be in a compressive state so as to exert an upward force on the friction shoe 60.

Upward movement of the friction shoe 60 is limited by engagement of a wear surface 72 formed on a rear of each of the triangular wing portions 64 of the shoe 60. Each wear surface 72 is also double sloped on a downward and outward angle to form a convex-like seating area 74. The seating area 74 mates in a complementary manner with the concave receiving area 58 of the friction shoe pocket 32. As may be seen in FIG. 5, the downward slope of the rear surface 72 proximates 45 degrees and as may be seen in FIG. 8, the outward slope of such proximates 3 degrees.

Integrally forming an outer end 76 of each shoe wing wear surface 72 is a flange 78 which projects outwardly from shoe wing 64. Each flange 78 serves as a slide within a groove 80 defined by the bolster pocket friction member 48 and a rib 82 formed respectively on the inner and outer sidewalls 52, 54 of the pocket 32. The groove 80 is substantially parallel to the downward slope of the pocket friction surface 56 and helps to prevent the shoe 60 from becoming dislodged when the truck 10 is subjected to severe impact.

During operation of the truck 10, there is continuous three-directional movement between the bolster 14 and the side frame 12. Such movements vary in degree as related to the speed at which the truck 10 is traveling, the condition of the track on which the truck 10 is riding and the magnitude of the load supported by the truck 10 as transferred to the bolster 14 through a center plate 84. As is understood, the center plate 84 connects a body of the railroad car (not shown) to the truck 10.

Vertical movement between the bolster 14 and side frames 12 is intended and in the downward direction is cushioned by the spring set 26. All vertical movement is in part regulated by a frictional engagement of the vertical friction surface 70 of each friction shoe 60 with the wear plates 30 carried by the side frames 12.

This frictional engagement produces a desired dampening effect and is held at a near constant value because the coefficient of friction and the value of normal force applied by the friction shoe 60 against the wear plate 30 remain substantially unchanged during operation. The unchanging condition is assured by the fact that friction shoe 60 in the bolster pocket 32 remains substantially centered within each pocket and the engaging surfaces 56, 72 remain properly aligned. Thus, the spring which urges each friction shoe 60 upward remains in a near constant compressive state.

Additionally, during operation of the truck 10, it is most desirable to maintain the side frame 12 and the bolster 14 in a squared relationship. Because of dynamic forces created during operation of the truck 10, the side frames have a tendency to lozenge wherein the side frames remain parallel but become longitudinally offset. When such occurs, the bolster 14 move to an out-of-square position. When lozenging occurs, the critical speed at which wheelsets (not shown) of the truck 10 will hunt, i.e. dynamically induced oscillating about a vertical axis of the wheelset, is lowered. Hunting is most undesirable and increased lozenging tends to make a bad situation worse. Because the friction surfaces 56 of the bolster pocket 32 provide the receiving area 58 having a concave-like configuration and the friction shoe wear surfaces 72 provide a seating area 74 having a complementary convex-like configuration, the friction shoe 60 may more readily maintain the bolster 14 and side frame 12 in this desirably squared position and thus prevent lozenging of the side frames. Movement from this squared position is inhibited by a wedging effect created between the pocket receiving area 58 and the shoe seating area 74.

In a like manner, it is desirable to resist rolling of the car body during movement of the railroad car. When such rolling occurs, the bolster 14 likewise pitches and rolls so as to move the bolster 14 to an out-of-square relationship with the side frames. The side frame 12 may likewise roll to disturb the desired squared relationship between side frame 12 and bolster 14. The inhibiting wedging effect created between the bolster pocket concave-like receiving area 58 and the convex-like seating area 74 of the friction shoe 60 helps to prevent such an out-of-square condition to occur. Thus, this wedging effect provides three-dimensional stability to the operation of the truck.

While various modifications may be suggested by those versed in the art, it should be understood that we wish to embody within the scope of the patent warranted hereon, all such modifications as reasonably and properly come within the scope of our contribution to the art.

What is claimed is:

1. In a railroad car truck including a pair of spaced side frames joined by a transversely positioned bolster having ends resiliently carried in a window formed in each said side frame, the improvement therein comprising, a pair of friction shoe pockets formed in each said end of said bolster, one each of said pair facing to a front and to a rear of said truck, each said pocket having by a pair of spaced friction members each having a double sloped friction surface formed on a downward and outward angle to form an overall concave-like receiving area, and a set of four friction shoes, one each of said shoes disposed in each of said friction shoe pockets, each said shoe having a pair of spaced double sloped wear surfaces formed on a downward and outward angle to form an overall convex-like seating area for complementary engagement with said bolster pocket receiving area, an area of said contact between said bolster receiving area and said friction shoe seating area being substantial, wherein said shoe remains centered within said pocket to provide a three-dimensional wedging effect to improve dynamic stability of said truck by maintaining said side frames and said bolster in a squared relationship while each said friction shoe regulates in part vertical movements of said bolster.

2. A railroad car truck having a pair of spaced elongated side frames positioned in a parallel manner, each said side frame formed with a centrally located window defined by a bottom tension member, a top compression member and spaced sidewalls, and an elongated bolster positioned laterally between said side frames with ends resiliently supported by a set of springs carried on the bottom tension member of each side frame window, the improvement in said truck comprising, friction shoe pockets formed one each on each side of a longitudinal axis of said bolster at said ends of said bolster, each said pocket defined by a bottom member and a top member having a centrally located and outwardly facing recess formed therein, said top member joined to said bottom member by a U-shaped partition aligned with said recess, said partition having downwardly sloped end walls connected with sidewalls of said pocket by spaced friction members, each said friction member having a double sloped friction surface formed on a downward and outward angle, and a friction shoe carried one each in said bolster friction shoe pockets, said shoe including a central body portion having a bottom prepared to receive an upper end of a compression spring carried on said pocket bottom member, and a pair of triangular spaced wings each having an end flange, one each of said wings carried on each side of said body member, each said wing having a double sloped wear surface formed on a downward and outward angle, said shoe disposed in said pocket with said friction shoe body portion loosely carried within said U-shaped partition and with each said flange forming a guide in a groove defined by each said pocket friction member and a rib carried on each said pocket sidewall, said spaced wear surfaces of said shoes engaging with said spaced friction surfaces of said pockets with areas of said engagement of said surfaces being substantial to produce a wedging effect to maintain said shoes centered and squared within said bolster pockets respectively, said shoes maintaining said bolster and said side frame in a squared relationship during operation of said truck as vertical movements of said bolster are dampened by a vertical friction surface of each said shoe engaging with a vertical wear plate fastened to each said sidewall of said side frame windows respectively.

* * * * *